US005350968A

United States Patent [19]

Kwon

[11] Patent Number: 5,350,968

[45] Date of Patent: Sep. 27, 1994

[54] DEFLECTION YOKE MOUNTING APPARATUS FOR A COLOR PICTURE TUBE

[75] Inventor: Soo K. Kwon, Kumi-si, Rep. of Korea

[73] Assignee: Gold Star Co., Ltd., Seoul, Rep. of Korea

[21] Appl. No.: 935,887

[22] Filed: Aug. 28, 1992

[30] Foreign Application Priority Data

Aug. 29, 1991 [KR] Rep. of Korea ..... 13908/1991

[51] Int. Cl.[5] ..... H01J 29/70

[52] U.S. Cl. ..... 313/440; 313/421

[58] Field of Search ..... 313/421, 440, 425; 156/84, 85

[56] References Cited

U.S. PATENT DOCUMENTS 4,207,364 6/1980 Nyberg ..... 156/84
5,129,608 7/1992 Goldman .
5,169,176 12/1992 Brossard ..... 156/84
5,172,877 12/1992 Hattori et al. .

*Primary Examiner*—Donald J. Yusko
*Assistant Examiner*—Vip Patel
*Attorney, Agent, or Firm*—Finnegan, Henderson Farabow, Garrett & Dunner

[57] ABSTRACT

A deflection yoke mounting apparatus for a color picture tube having a deflection yoke for deflecting electron beams generated by an electron gun to be securely fixed to a neck portion of a funnel of the picture tube to prevent deterioration of convergence and purity characteristics of the picture tube due to displacement of the yoke by an external shock. The apparatus includes a thermal shrinkage tube inserted over the outer periphery of the neck portion and thermally contracted into close contact with the neck portion, a neck contact member of the deflection yoke having a plurality of protrusions formed on its inner surface and engaged with the outer periphery of the thermal shrinkage tube, and a metallic band engaged with the outer periphery of the thermal shrinkage tube, the metallic band being engaged with the outer periphery of the neck contact member to press the contact member and the thermal shrinkage tube, thus fixing the yoke to the neck portion.

2 Claims, 2 Drawing Sheets

DEFLECTION YOKE MOUNTING APPARATUS FOR A COLOR PICTURE TUBE

BACKGROUND OF THE INVENTION

1. Field of the Invention

This invention relates to a deflection yoke mounting apparatus for a color picture tube, and more particularly to a deflection yoke mounting apparatus for a color picture tube, that allows a deflection yoke to be securely fixed to a neck portion of a funnel of the picture tube to prevent deterioration of convergence and purity characteristics of the picture tube due to displacement of the yoke by an external shock.

2. Description of the Prior Art

Generally, a color picture tube has a form of a cone-shaped vacuum bulb comprising a panel (not shown) having phosphor applied in forms of dots or strips to its inner surface, and a funnel 2 integrated with the panel and having a neck portion 2*a'* of a reduced cross-section, as shown in FIG. 1 of the accompanying drawings. In addition, the picture tube includes an electron gun mounted internally in the neck portion 2*a'* to generate and direct electron beams to the phosphor of the panel, and a deflection yoke 3 fixedly mounted externally on the neck portion to deflect the electron beams.

With the color picture tube thus constructed, the electron beams emitted from the electron gun and passed through grids are deflected by the deflection yoke 3. The electron beams pass through small through-holes of a shadow mask for color selection, and then land on the phosphor of the panel to cause the luminescence of the phosphor. Thus, a picture image is formed on the screen. At this time, if a displacement of the deflection yoke occurs, convergence and purity characteristics of the picture tube may deteriorate, so that an image of good quality may not be produced. Therefore, in order to obtain an image of good quality, it is necessary to securely fix the deflection yoke 3 to the neck portion 2*a'* of the funnel to prevent displacement.

An example of a deflection yoke mounting apparatus for a color picture tube according to the prior art is shown in FIGS. 1, 2A, and 2B of the accompanying drawings. The deflecting yoke 3 of FIGS. 1, 2A and 2B comprises horizontal deflection coils(not shown) for correction of horizontal convergence wound into a saddle shape and disposed internally in a separator 8 of an insulating material and vertical deflection coils 7 for correction of vertical convergence round into a toroidal shape and disposed externally on the separator. The deflection yoke 3 is mounted on the neck portion 2*a* of the funnel through an adhesive tape 10 having on one side surface an adhesive material 9 bonded to the outer surface of the glass neck portion 2*a'*. More particularly, as shown in FIG. 2B, the adhesive tape 10 is first bonded around the outer periphery of the neck portion, and then a neck contact member 4 of the deflection yoke having protrusions 4*a* formed on its inner surface is inserted over the bonded adhesive tape and tightly clamped by a metallic band 5 wrapped around its outer periphery. The metallic band 5 is fastened by a bolt 6 which is threadedly engaged in threaded through-holes 5*a* formed at opposite ends of the band. As a result, the deflection yoke is fixed to the neck portion 2*a'* of the funnel to act against displacement.

This prior apparatus, however, has a drawback in that although the deflection yoke has been accurately assembled to the neck portion taking into consideration the convergence and purity characteristic in the manufacturing process, the yoke 3 exhibits a tendency to be displaced relative to the glass neck portion 2*a'* during transportation or use of the product, so that a picture image of good quality may not be obtained. In addition, during operation of the color picture tube, the temperature of the neck portion rises up to 60° C.~80° C. due to heat generated by a heater of the electron gun disposed in the neck portion. As a result, the adhesive force the adhesive tape bonded to the neck portion is weakened. Thus, even a minute shock is applied to the picture tube may displace the deflection yoke thereby deteriorating the convergence or purity characteristics of the picture tube.

SUMMARY OF THE INVENTION

In view of the aforesaid problem of the prior apparatus, it is an object of the present invention to provide a deflection yoke mounting apparatus for a color picture tube, that prevents deterioration of convergence or purity characteristics of the picture tube, resulting from a displacement of the deflection yoke by an external force.

To achieve the above object and according to one embodiment of the present invention a deflection yoke mounting apparatus for a color picture tube is provided comprising a thermal shrinkage tube inserted over a neck portion of a funnel of the picture tube and thermally contracted into close contact with the neck portion, a neck contact member of a deflection yoke having a plurality of protrusions formed on its inner surface and engaged with the outer periphery of the thermal shrinkage tube, and fastening means engaged with the outer periphery of the neck contact member to press the contact member and the thermal shrinkage tube, thereby fixing the deflection yoke to the neck portion.

DESCRIPTION OF THE PREFERRED EMBODIMENT

The invention will now be described in more detail, by way of example, with reference to FIGS. 3 and 4 of the accompanying drawings.

Figure 1:
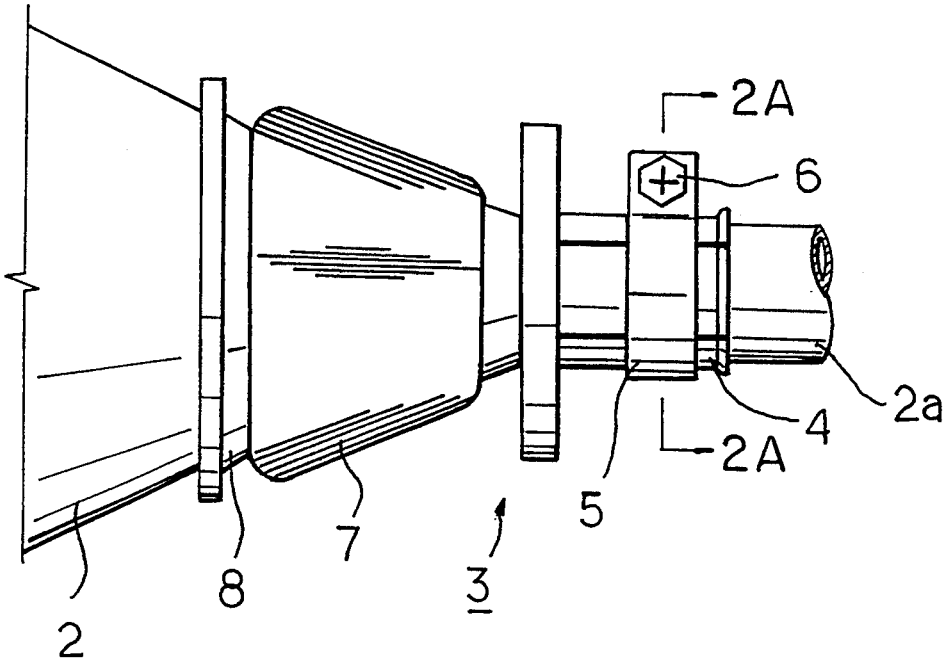
FIG. 1 PRIOR ART
FIG. 1 is a schematic side view illustrating a neck portion of a funnel of a color picture tube with a deflection yoke mounted thereon according to the prior art.
Figure 2B:
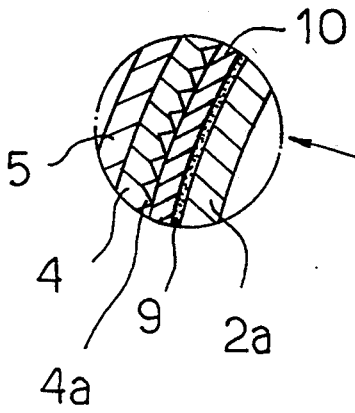
FIG. 2B PRIOR ART
FIG. 2B is an enlarged schematic view illustrating (1 section of FIG. 2A.
Figure 2A:
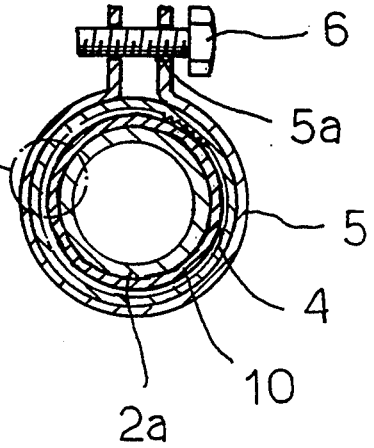
FIG. 2A PRIOR ART
FIG. 2A is a cross-sectional view of line 2A—2A of FIG. 1.
Figure 3:
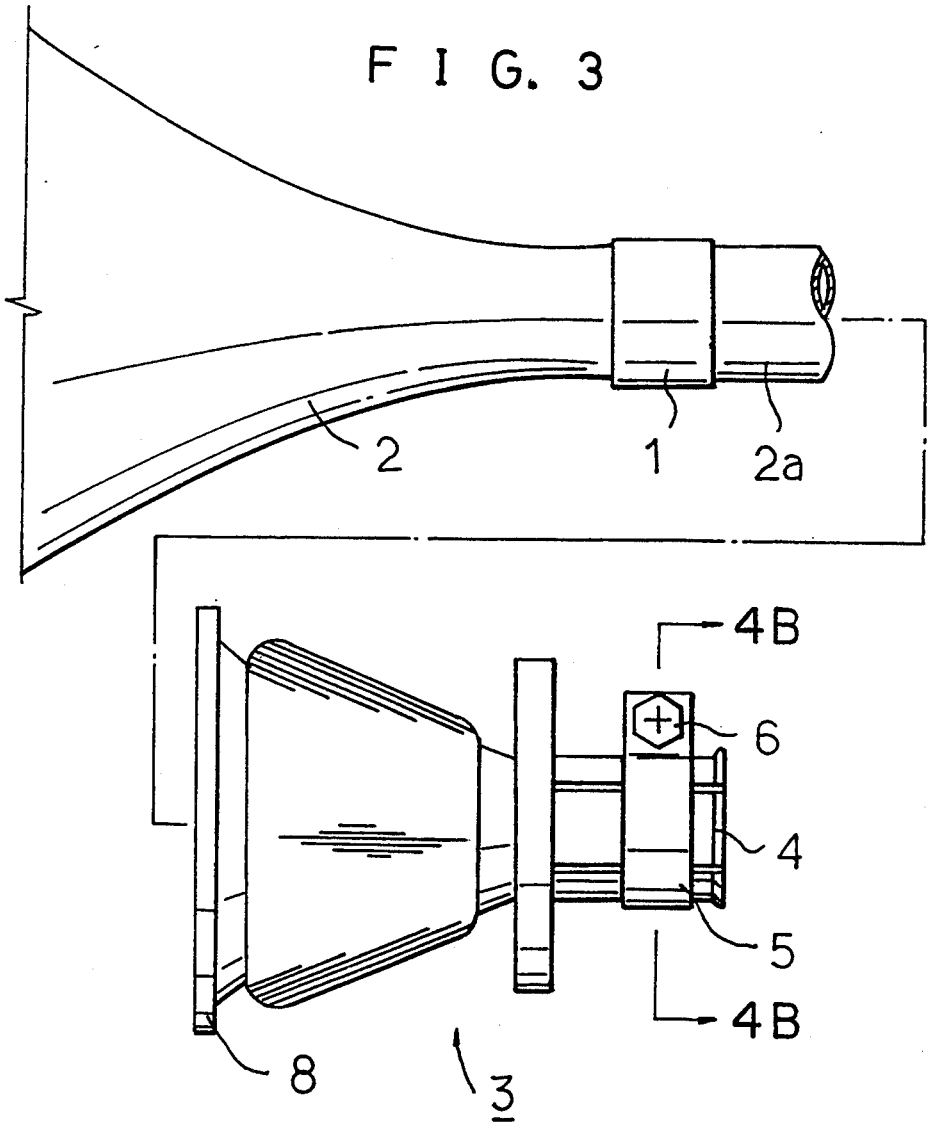
FIG. 3 is an enlarged schematic, view illustrating the neck portion of the funnel with the deflection yoke mounted thereon according to the present invention.
Figure 4:
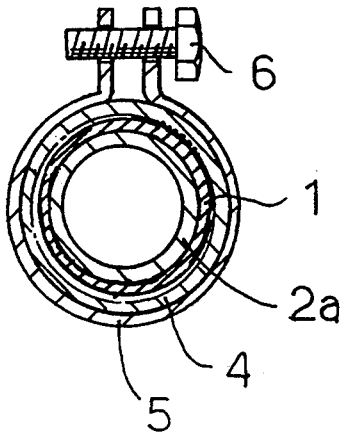
FIG. 4 is a cross-sectional view of line 4B—4B of FIG. 3, showing the deflection yoke mounting apparatus according to the present invention.

FIG. 3 shows a deflection yoke being mounted on a neck portion of a funnel of a color picture tube according to a preferred embodiment of the present invention. FIG. 4 shows a cross-sectional view of the deflection yoke mounting apparatus according to the present invention, taken along line 4B—4B of FIG. 3. The apparatus according to the present invention is similar to the prior art in that the deflection yoke 3 comprises a separator 8 having horizontal deflection coils (not shown) and vertical deflection coils 7 wound internally and externally thereof, respectively, and is mounted around the neck portion 2*a'* of the funnel 2. However, the present invention utilizes a hollow, thermal shrinkage tube 1 inserted over the neck portion 2*a'*, thereby preventing displacement of the yoke. Therefore, elements similar to those of the prior art are indicated by the same reference numbers and not explained in detail here to avoid the duplication of explanation.

The thermal shrinkage tube 1 preferably has an inside diameter of about 0.2~0.4 mm greater than the outside diameter of the neck portion 2*a'*, and more preferably, 0.3 mm greater than the outside diameter of the neck portion 2*a*. For example, a color picture tube having a neck portion with an outside diameter of 29.1 mm should have a thermal shrinkage tube 1 with an inside diameter in the range of 29.3~29.5 mm.

The reason for defining the inside diameter of the thermal shrinkage tube to be 0.2~0.4 mm greater than the outside diameter of the neck portion is to take into consideration the workability in the manufacturing process of the picture tube. If the inside diameter of the tube 1 is less than the outside diameter of the neck portion 2*a'*, it would be difficult to place the tube on the neck portion. To the contrary, if the inside diameter of the tube is far greater than the diameter of the neck portion, i.e., exceeding the range of 0.2~0.4 mm, the tube may not be accurately mounted at a predetermined position due to a shift in position which may occur when mounting the tube on the outer periphery of the neck portion and heating the tube by a heater (not shown).

The process of mounting the deflection yoke 3 on the neck portion 2*a'* of the funnel 2 by using the thermal shrinkage tube 1 will now be explained.

First, the thermal shrinkage tube 1 is placed at a predetermined position on the neck portion 2*a'*, and then heated uniformly along its outer circumference by a separate heater, thus contracting the shrinking tube to tightly engage the neck portion. Then, the deflection yoke 3 is inserted over the tube 1 such that a metallic band 5 wrapped around a neck contact member 4 of the yoke is in register with the thermal shrinkage tube. Thereafter, the yoke position is adjusted to provide optimum convergence and purity of the color picture tube, and then a bolt 6 threadedly engaged in threaded through-holes 5*a* formed at opposite ends of the band 5 is slowly tightened such that protrusions 4*a* formed on the inner surface of the contact member 4 press the thermal shrinkage tube 1 into close contact with the neck portion.

With the color picture tube thus constructed, as the temperature of the neck portion 2*a'* rises due to heat generated by a heater of an electron gun in the neck portion during operation of the picture tube,the thermal shrinkage tube 1 is further contracted into more close contact with the neck portion, whereby the deflection yoke 3 is more securely fixed to the neck portion.

The present invention is advantageous in that since the deflection yoke is securely fixed to the neck portion through the thermal shrinkage tube firmly engaged with the neck portion of the funnel, the yoke is not displaced even when subjected to an external shock. Therefore, convergence and purity adjusted in the manufacturing process of the picture tube are kept constant during use of the picture tube, resulting in an enhanced reliability of the product.

While the invention has been shown and described with particular reference to the preferred embodiment thereof, it will be understood that variations and modifications in form and detail may be made therein without departing from the spirit and scope of the invention as defined in the appended claims.

What is claimed is:

1. A deflection yoke mounting apparatus for a picture tube having a deflection yoke and a funnel with a neck portion comprising:

a thermal shrinkage tube inserted over an outer periphery of said neck portion and thermally contracted into close contact with said neck portion;

a neck contact member having a plurality of protrusions formed on its inner surface, said neck contact member being engaged with an outer periphery of said thermal shrinkage tube;

means engaged with an outer periphery of said neck contact member for fastening said neck contact member to said thermal shrinkage tube, said fastening means fixing said yoke to said neck portion; and said thermal shrinkage tube further contracting onto the neck portion when the neck portion is heated by an electron gun during operation of the color picture tube.

2. A deflection yoke mounting apparatus for a picture tube according to claim 1, wherein said thermal shrinkage tube has an inside diameter approximately in the range of 0.2~0.4 mm greater than an outside diameter of said neck portion of said funnel.

* * * * *